US009580236B1

(12) United States Patent
Skeid et al.

(10) Patent No.: US 9,580,236 B1
(45) Date of Patent: Feb. 28, 2017

(54) STORAGE AND TRANSPORT CONTAINER

(71) Applicants: Eirik Smedsrud Skeid, Fornebu (NO); Jonas Dovik, Oslo (NO)

(72) Inventors: Eirik Smedsrud Skeid, Fornebu (NO); Jonas Dovik, Oslo (NO)

(73) Assignee: Mobile Shelter Systems AS, Fornebu (NO)

( * ) Notice: Subject to any disclaimer, the term of this patent is extended or adjusted under 35 U.S.C. 154(b) by 120 days.

(21) Appl. No.: 14/598,538

(22) Filed: Jan. 16, 2015

(51) Int. Cl.

| | |
|---|---|
| ***B65D 88/00*** | (2006.01) |
| ***B65D 88/12*** | (2006.01) |
| ***B65D 90/54*** | (2006.01) |
| ***B65D 85/06*** | (2006.01) |

(52) U.S. Cl.
CPC ..... *B65D 88/005* (2013.01); *B65D 85/06* (2013.01); *B65D 88/12* (2013.01); *B65D 90/54* (2013.01)

(58) Field of Classification Search
CPC ..... F17C 13/084; F17C 2205/0107; F17C 2201/0109; F17C 2201/032; F17C 2221/011; F17C 2221/014; F17C 2221/017–2221/018; A47B 45/00; A47B 81/007; A47F 5/0087; A47F 5/0807; A47F 5/137; A47F 7/04; B65D 2519/00164; B65D 2519/00059; B65D 2519/00233; B65D 2519/00512; B65D 2519/00532; B65D 2519/00298; B65D 2519/00995; B65D 2519/00606; B65D 2519/00611; B65D 2519/00626; B65D 19/12; B65D 19/385; B65D 88/121
USPC ... 206/304.2, 340; 211/20, 23–24, 175, 208, 211/180, 189, 194–195, 85.8, 183; 180/55.1, 56.1
See application file for complete search history.

(56) References Cited

U.S. PATENT DOCUMENTS

| | | | | |
|---|---|---|---|---|
| 2,928,540 A | | 3/1960 | Cunningham | |
| 3,322,286 A | | 5/1967 | Sylvester | |
| 3,407,926 A | | 10/1968 | Rosser | |
| 3,459,326 A | * | 8/1969 | Betjemann | B65D 88/005 206/512 |
| 3,547,258 A | | 12/1970 | Black | |
| 3,812,974 A | | 5/1974 | Sylvester | |
| 3,850,295 A | | 11/1974 | Black | |
| 3,915,303 A | | 10/1975 | Tatham | |
| 3,981,410 A | * | 9/1976 | Schurch | B65D 19/08 206/511 |
| 3,987,915 A | | 10/1976 | Conner | |

(Continued)

*Primary Examiner* — Bryon Gehman
*Assistant Examiner* — Brijesh V. Patel
(74) *Attorney, Agent, or Firm* — Michael A. Blake

(57) ABSTRACT

A storage and transport container comprising: a lower front member; a first post attached to the first end of the lower front member; a second post attached to the second end of the lower front member; a floor front member attached to the first post and the second post, and located below the lower front member; a rotatable gate rotatably attached to the lower front member, and lockably attachable to the first post and the second post; a first tab extending from the first post, with a first hole located in the first tab; a first spring loaded gate lock attached to the rotatable gate, the first spring loaded gate lock comprising a first gate locking member configured to generally constantly be forced into a locked position by the spring and configured to slide into the first hole in order to lock the first spring loaded gate lock.

5 Claims, 7 Drawing Sheets

(56) References Cited

U.S. PATENT DOCUMENTS 4,290,370 A 9/1981 Gallagher
4,295,431 A 10/1981 Stavlo
4,714,169 A 12/1987 Keenan
4,836,395 A * 6/1989 Goutille ..... B65D 88/121 220/1.5
5,261,550 A * 11/1993 Karpisek ..... B65D 9/12 220/1.5
5,324,105 A * 6/1994 Christensen ..... A47F 7/0057 206/303
5,378,093 A * 1/1995 Schroeder ..... B61D 45/006 211/41.15
5,378,106 A 1/1995 Risley
5,388,532 A * 2/1995 Wakano ..... B65D 19/12 108/54.1
5,626,241 A 5/1997 Holden
5,671,850 A 9/1997 Basala
6,044,990 A 4/2000 Palmeri
6,164,476 A 12/2000 Rene
6,227,397 B1 * 5/2001 Kim ..... B65D 88/005 220/1.5
6,273,670 B1 8/2001 Henson
6,298,999 B1 10/2001 Bellman
6,422,405 B1 7/2002 Haenszel
6,637,077 B2 10/2003 Doty
6,691,885 B2 * 2/2004 Brown ..... B65D 19/12 220/1.5
RE39,444 E 12/2006 Rene
7,328,804 B2 * 2/2008 Andre ..... B65D 19/12 206/386
7,997,441 B2 * 8/2011 Marcel ..... B65D 88/128 206/386
2006/0144838 A1 * 7/2006 Winn ..... B65D 19/06 220/7
2006/0156694 A1 7/2006 Aubin
2006/0214446 A1 9/2006 Johns
2007/0158345 A1 * 7/2007 Booth ..... B62B 3/16 220/6
2009/0148260 A1 6/2009 Leimbach

* cited by examiner

STORAGE AND TRANSPORT CONTAINER

TECHNICAL FIELD

The invention relates to storage and transport containers, and more particularly, to storage and transport containers for storing and transporting cargo such as, but not limited to vehicle tires and/or wheels.

BACKGROUND

There is a need to package large quantities of different sized vehicle wheels for transport. The primary means of transportation are shipping containers and as secondary loads in vehicles, such as pick up trucks, humvees, tractor trailers, etc. Therefore the wheels need to be packaged on an apparatus that is moveable and transportable because packaging of the wheels may occur prior to loading containers or trucks. The wheel weights may range from about 50 lbs to about 1000 lbs or more, thus the apparatus needs to be strong enough to support heavy loads. Additionally, there is a need to maximize the available space inside of the shipping container or truck (or other vehicle carrying a secondary load) by volume. A new regulation for Government Agencies who ship wheels is that the wheels should be stored vertically to extend the life of the wheels while in storage. It has been determined that flat packing of wheels on top of each other cause the wheels to deteriorate in storage.

Currently, the commercial practice of packing wheels for shipping in trucks is to have them individually loaded and off loaded by people. This is time intensive, and risks injury to those loading and unloading the wheels. For other transport, wheels are packed flat on wooden pallets and then secured to the pallet for transport. Using pallets often leads to flat stacking of wheels in violation of government regulations.

Thus there is a need for a wheel storage and transport device that overcomes the above listed and other disadvantages.

SUMMARY OF THE INVENTION

The disclosed invention relates to a storage and transport container comprising: a lower front member; a first post attached to the first end of the lower front member; a second post attached to the second end of the lower front member; a floor front member attached to the first post and the second post, and located below the lower front member; a rotatable gate rotatably attached to the lower front member, and lockably attachable to the first post and the second post; a first tab extending from the first post, with a first hole located in the first tab; a first spring loaded gate lock attached to the rotatable gate, the first spring loaded gate lock comprising a first gate locking member configured to generally constantly be forced into a locked position by the spring and configured to slide into the first hole in order to lock the first spring loaded gate lock, the first gate locking member comprising a chamfered end configured to automatically move into an unlocked position by the first tab pushing on the chamfered end when the first spring loaded gate is rotated closed, until the chamfered end is aligned with the first hole, whereupon the first gate locking member automatically is pushed into the hole by the spring and thus locks the first spring loaded gate lock with respect to the first post.

The invention also relates to a storage and transport container comprising: a first post; a second post; a third post; a fourth post; a first lower side member attached to the first post and the fourth post; a second lower side member attached to the second post and the third post; a first lower bar attached to the first lower side member and the second lower side member; a second lower bar attached to the first lower side member and the second lower side member, the second lower bar generally parallel to the first lower bar, and at least about 15.5 inches from the first lower bar, center to center; a first post member slideably attached to the first post, and configured to extend out of and retract into the first post, the first post member comprising a plurality of first member holes located along the length of the first post member; a second post member slideably attached to the second post, and configured to extend out of and retract into the second post, the second post member comprising a plurality of second member holes located along the length of the second post member; a third post member slideably attached to the third post, and configured to extend out of and retract into the third post, the third post member comprising a plurality of third member holes located along the length of the third post member; a fourth post member slideably attached to the fourth post, and configured to extend out of and retract into the fourth post, the fourth post member comprising a plurality of fourth member holes located along the length of the fourth post member; a first top side member attached to the first post member and the fourth post member; a second top side member attached to the second post member and the third post member; a first top bar attached to the first top side member and the second top side member, and generally parallel to the first and second lower bars; a second top bar attached to the first top side member and the second top side member, the second top bar generally parallel to the first top bar, and at least about 20.5 inches from the first top bar, center to center, and generally parallel to the first and second lower bars; a first spring loaded lock in communication with the first post, the first spring loaded lock comprising: a first post hole, the first pole hole configured to be aligned with at least one of the first member holes; a first locking member configured to slide though the first post hole and at least one first member hole aligned with the first post hole; where depending on which of the first member holes the first locking member has slid through, the first post member can be extended or retracted into the first post; a second spring loaded lock in communication with the second post, the second spring loaded lock comprising: a second post hole, the second pole hole configured to be aligned with at least one of the second member holes; a second locking member configured to slide though the second post hole and at least one second member hole aligned with the second post hole; where depending on which of the second member holes the second locking member has slid through, the second post member can be extended or retracted into the second post; a third spring loaded lock in communication with the third post, the third spring loaded lock comprising: a third post hole, the third pole hole configured to be aligned with at least one of the third member holes; a third locking member configured to slide though the third post hole and at least one third member hole aligned with the third post hole; where depending on which of the third member holes the third locking member has slid through, the third post member can be extended or retracted into the third post; a fourth spring loaded lock in communication with the fourth post, the fourth spring loaded lock comprising: a fourth post hole, the fourth pole hole configured to be aligned with at least one of the fourth member holes; a fourth locking member configured to slide though the fourth post hole and at least one fourth member hole aligned with the fourth post hole; where depending on which of the fourth member holes the fourth locking member has slid through, the fourth post member can be extended or refracted into the fourth post; where the storage and transport container is configured such that the first, second, third and fourth post members can be extended and retracted with respect to the first, second and third, and fourth posts respectively, such that that first and second top bars and the first and second lower bars can abut an object being stored and/or transported in the container.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
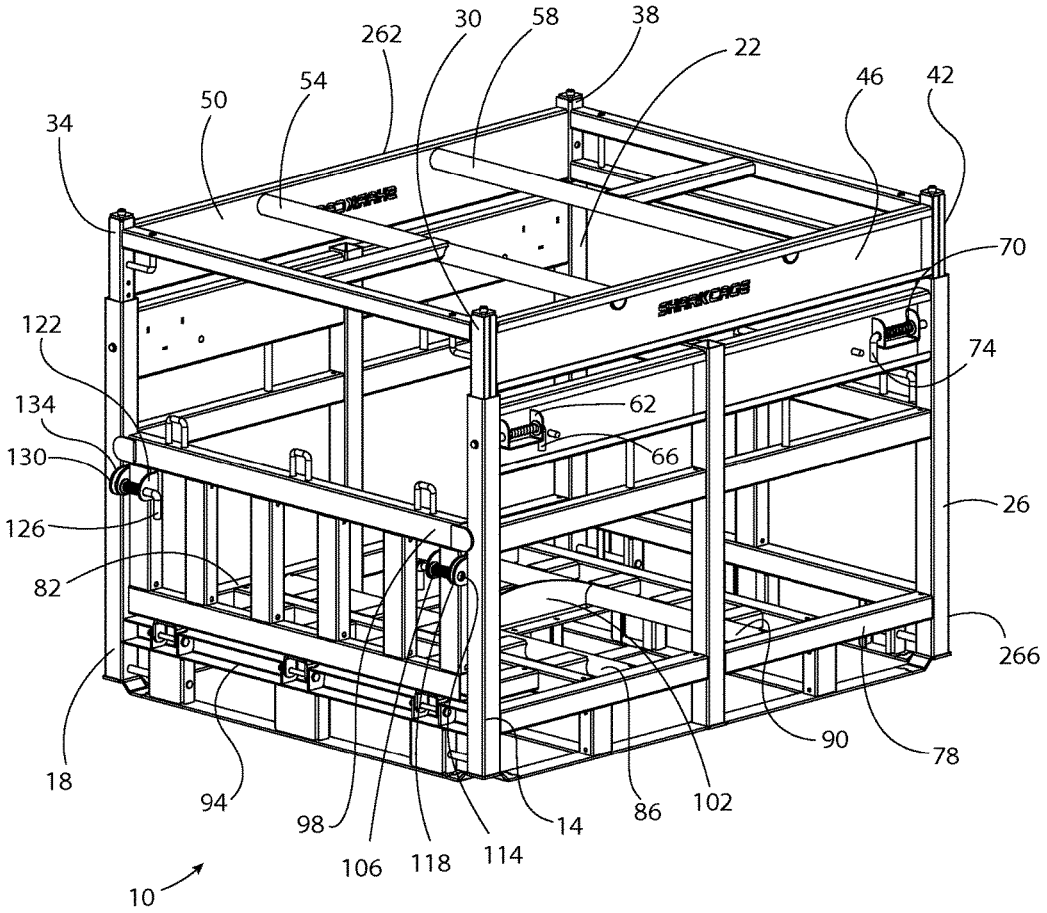
FIG. 1 is a perspective view of the storage and transport container.

FIG. 1 shows a front perspective view of the storage and transport container 10. The container 10 comprises a first post 14, second post 18, third post 22, and fourth post 26. The container 10 also comprises a first post member 30, second post member 34, third post member 38, and fourth post member 42. The members 30, 34, 38, 42 slide generally within their respective posts 14, 18, 22, 26. The first member 30 and fourth member 42 are connected to a first adjustable top side member 46. The second member 34 and third member 38 are connected to a second adjustable top side member 50. A first top bar 54, and second top bar 58 are both attached to the first and second adjustable top side members 46, 50. The top bars 54, 58 may generally have a circular cross-section, and may be configured to secure circular objects such as wheels and/or tires as will be shown below. The first post 14 has a first spring loaded lock 62 attached to it (or in communication with the first post), with a first locking member 66 configured to slide though at least one hole in the post 14. The first spring loaded lock 62 is configured to removeably lock into place the first post member 30 with respect to the post 14. In one embodiment, the first post member 30 has a plurality of holes at different points along the length of the post member 30, and in this way, depending on which hole the first locking member 66 slides into, the amount that the first post member 30 can extend from the first post 14 can be varied from a minimum height to a maximum height. The fourth post 26 has a fourth spring loaded lock 70 attached to it (or in communication with the fourth post), with a fourth locking member 74 configured to slide though at least one hole in the post 26. The fourth loaded lock 70 is configured to removeably lock into place the fourth post member 42 with respect to the post 26. In one embodiment, the fourth post member 42 has a plurality of holes at different points along the length of the post member 42, and in this way, depending on which hole the locking member 74 slides into, the amount that the fourth post member 42 can extend from the fourth post 26 can be varied from a minimum height to a maximum height. Similarly to the First post 14 and fourth post 26, the second post 18 and third post 22 each have a second spring loaded lock and third spring loaded lock, respectively, configured to allow the second post member 34 and third post member 38, respectively, be locked into place with respect to the second post 18 and third post 22 from a minimum height to a maximum height. However, the second and third spring loaded locks are not visible in this view. The first post 14 and fourth post 26 are connected to a first lower side member 78. The second post 18 and third post 22 are connected to a second lower side member 82. A first lower bar 86, and second lower bar 90 are both attached to the lower side members 78, 82. The lower bars 86, 90 may generally have a circular cross-section, and may configured to secure circular objects such as wheels and/or tires as will be shown below. A generally semi-circular plate 102 is attached generally at the midpoint of both lower bars 86, 90. The generally semi-circular plate 102 provides additional strength to both lower bars 86, 90, and acts as a guide for placing wheels and other objects on the lower bars 86, 90. The plate 102 may be semi-circular, or any other suitable shape, including square, oval, rectangular, trapezoidal, triangular, etc. The first and second posts 14, 18 are attached to a lower front member 94. A front rotatable gate 98 is in rotatable communication with the lower front member 94. The gate 98 has a first spring loaded gate lock 106 with a first gate locking member 110 configured to slide into a hole 114 located in a first post tab 118 and locking the gate with respect to the first post 14. The first gate locking member 110 may be chamfered or beveled to allow the gate to be pushed into an upright and locked posting such that the chamfer or bevel on the locking member 100 will cause the locking member 110 to slide back into the spring loaded gate lock 106, then generally automatically engage with the hole 114 in the tab 118. The gate 98 also has a second spring loaded gate lock 122 with a second gate locking member 126 configured to slide into a hole 130 located in a second post tab 134 and locking the gate with respect to the second post 18. The second gate locking member 126 may be chamfered or beveled to allow the gate to be pushed into an upright and locked posting such that the chamfer or bevel on the locking member 126 will cause the locking member 126 to slide back into the spring loaded gate lock 122, then generally automatically engage with the hole 130 in the tab 134. The bars 54, 58, 86, 90 may also be hollow tubes.

Figure 2:
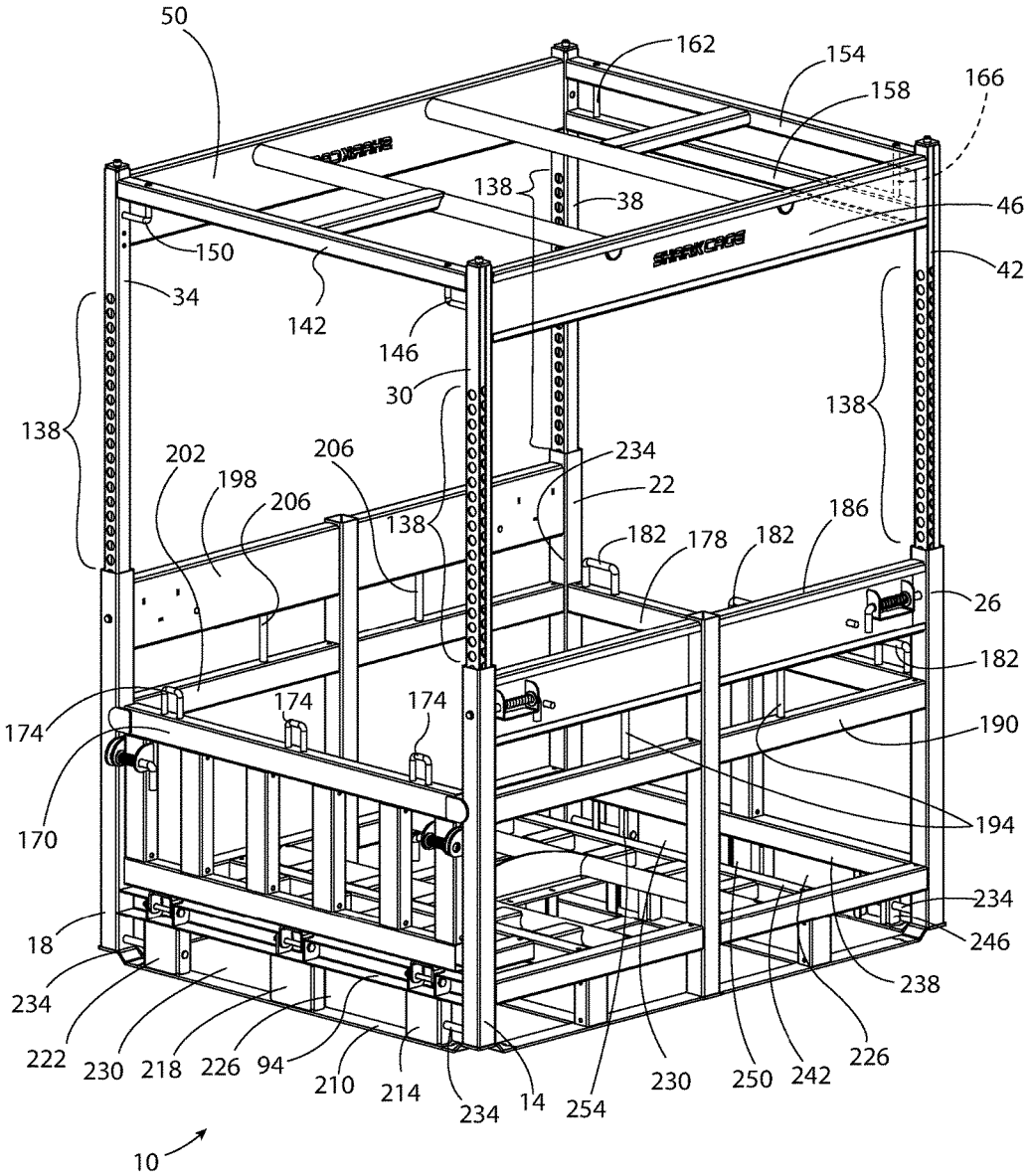
FIG. 2 is a perspective view of the storage and transport container from FIG. 1, with the top extended from the base.

FIG. 2 shows the first post member 30, second post member 34, third post member 38, and fourth post member 42 extended out of their respective posts 14, 18, 22, 26. In this view, the plurality of holes 138 in each member 30, 34, 38, 42 are visible. Strapping bars and sling loading points will be described in this figure. Attached to the first and second post members 30, 34 is a top front member 142. Attached to the top front member 142 and the first post member 30 is a first sling member 146. Attached to the top front member 142 and second post member 34 is a second sling member 150. Attached to the third post member 38 and the fourth post member 42 is a top rear member 154. Attached to the third post member 38 and the fourth post member 42 is a upper rear member 158, located below the top rear member 154. Attached to the top rear member 154 and upper rear member 158 is a third sling member 162, located adjacent to the third post member 38. Attached to the top rear member 154 and upper rear member 158 is a fourth sling member 166, located adjacent to the fourth post member 42. The sling members 146, 150, 162, 166 may be used for sling loading, that is the container can be carried by a helicopter or crane with a sling line and a swivel. The gate top member 170 may have one or more strapping bars 174. Attached to the third post 22 and fourth post 26 may be a mid member 178. Attached to the top of the mid member 178 may be one or more strapping bars 182. Attached to the first post 14 and fourth post 26 is a first top side member 186, and a first mid side member 190 located below the top side member. Attached to both the top side member 186 and mid side member 190 is at least one strapping bar 194. Attached to the second post 18 and third post 22 is a second top side member 198, and a second mid side member 202 located below the top side member. Attached to both the top side member 198 and mid side member 202 is at least one strapping bar 206. Attached to the first post 14 and second post 18 is a floor front member 210, the floor front member 210 is located also below the lower front member 94. Attached to both the floor front member 210 and lower front member 94 may be a first forklift guides 214, second fork lift guide 218, and third forklift guide 222. The forklift guides 214, 218, 222 define at least a first forklift pocket 226 and second forklift pocket 230. Attached to the first post 14 and the first forklift guide 214 may be a strapping bar 234. Attached to the second post 18 and third forklift guide 222 may be a strapping bar 234. Attached to the third post 22 and fourth post 26 is a lower rear member 238 and a floor rear member 242, the floor rear member 242 is located also below the lower rear member 238. Attached to both the floor rear member 242 and lower front member 238 may be a fourth forklift guide 246, fifth forklift guide 250, and sixth forklift guide 254. The forklift guides 246, 250, 254 also define at least a first forklift pocket 226 and second forklift pocket 230. Attached to the third post 22 and the sixth forklift guide 254 may be a strapping bar 234. Attached to the fourth post 26 and fourth forklift guide 246 maybe a strapping bar 234.

The container 10 comprises an adjustable top 262 and base 266. The adjustable top 262 can be extended and retracted into the base 266. In one embodiment, the top can be extended to so that the container has a height of about 6 feet, and the top can be lowered so the container has a height of about 3.5 feet. Of course, the container can be sized to be larger or smaller. The adjustable top 262 comprises the first post member 30, second post member 34, third post member 38, fourth post member 42, first top bar 54, second top bar 58, first adjustable top side member 46, second adjustable top side member 50, top front member 142, and top rear member 154. The base 266 comprises first post 14, second post 18, third post 22, fourth post 26, front rotatable gate 98, first top side member 186, and second top side member 198.

Figure 3:
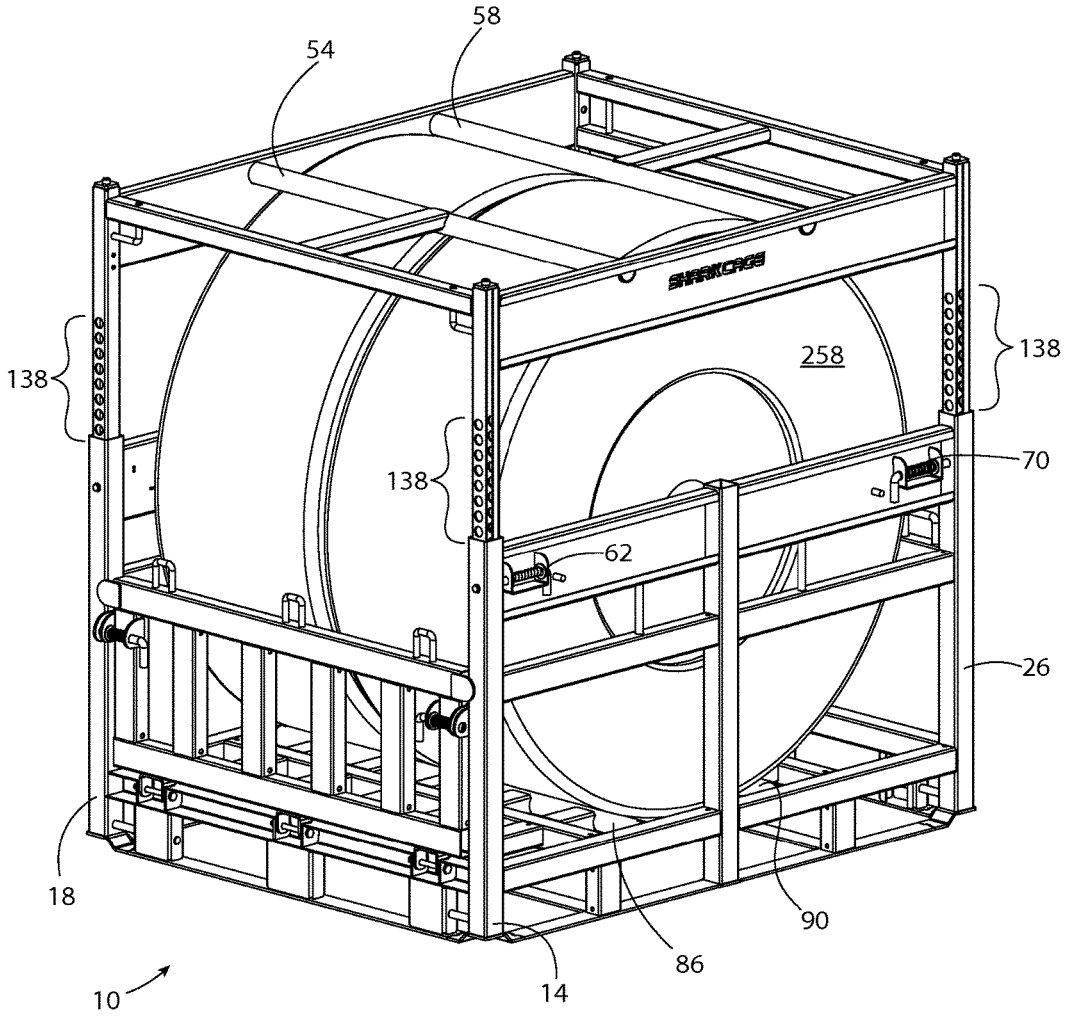
FIG. 3 is a perspective view of the storage and transport container with a tire inside of it.

FIG. 3 shows the storage and transport container 10 loaded with a large tire 258. The top 262 has been adjusted via the holes 138 and the first spring loaded lock 62, second spring loaded lock, third spring loaded lock, and fourth spring loaded lock 70. The first top bar 54, second top bar 58, first lower bar 86, second lower bar 90 lock the tire 258 in place. The top bars may be about 20.5 inches apart, center to center, but may range from about 6 inches apart to 80 inches apart, center to center, or more. The lower bars may be about 15.5 inches apart, center to center, but may range from about 6 inches apart to 80 inches apart, center to center, or more.

Figure 4:
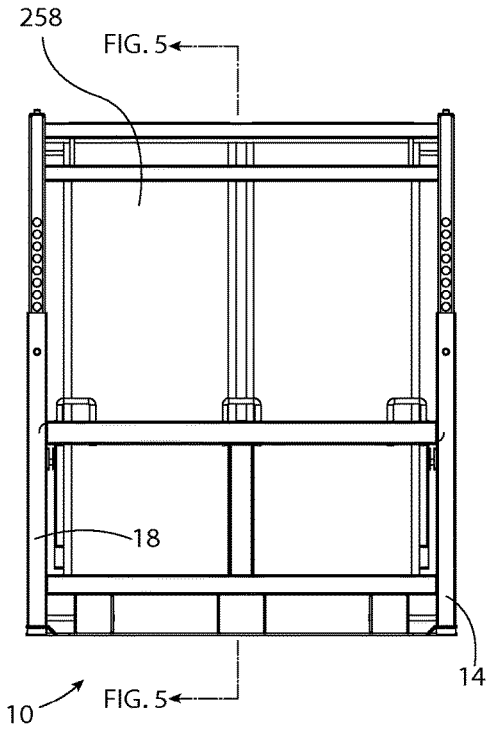
FIG. 4 is a front view of the storage and transport container.
Figure 5:
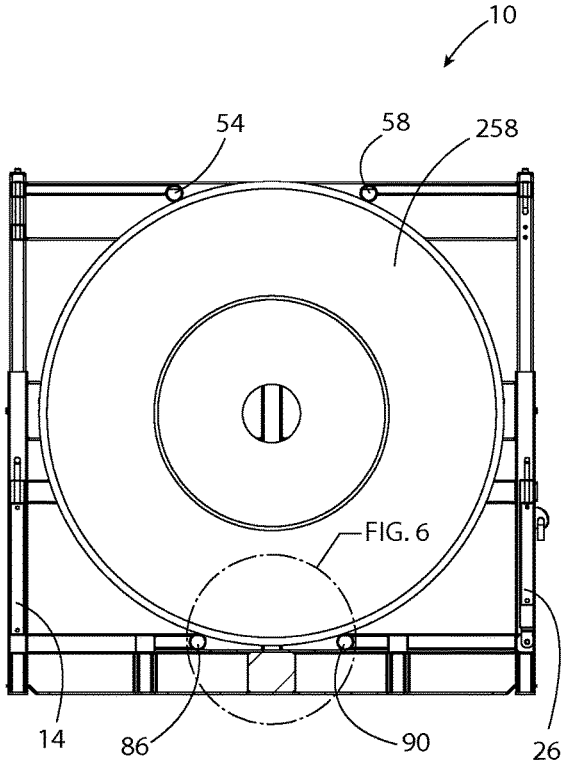
FIG. 5 is a cross-sectional view of the storage and transport container from FIG. 4.
Figure 6:
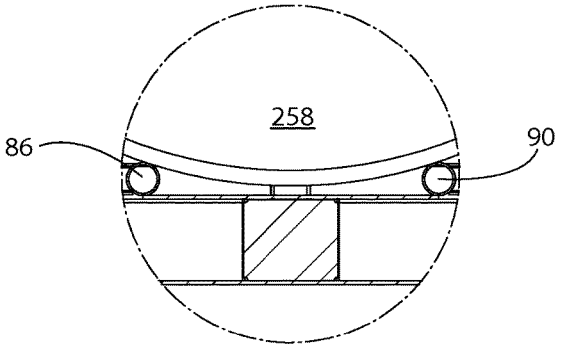
FIG. 6 is a detail view of the lower bars from FIG. 5.

FIG. 4 is a front view of the container 10 with the tire 258. FIG. 5 is a cross-sectional view of the container 10 from FIG. 4. In this view, the bars 54, 58, 86, and 90 are shown holding the tire 258 in place. FIG. 6 is a detail view from FIG. 5 showing how the tire 258 is held in place by the first lower bar 86 and second lower bar 90.

Figure 7:
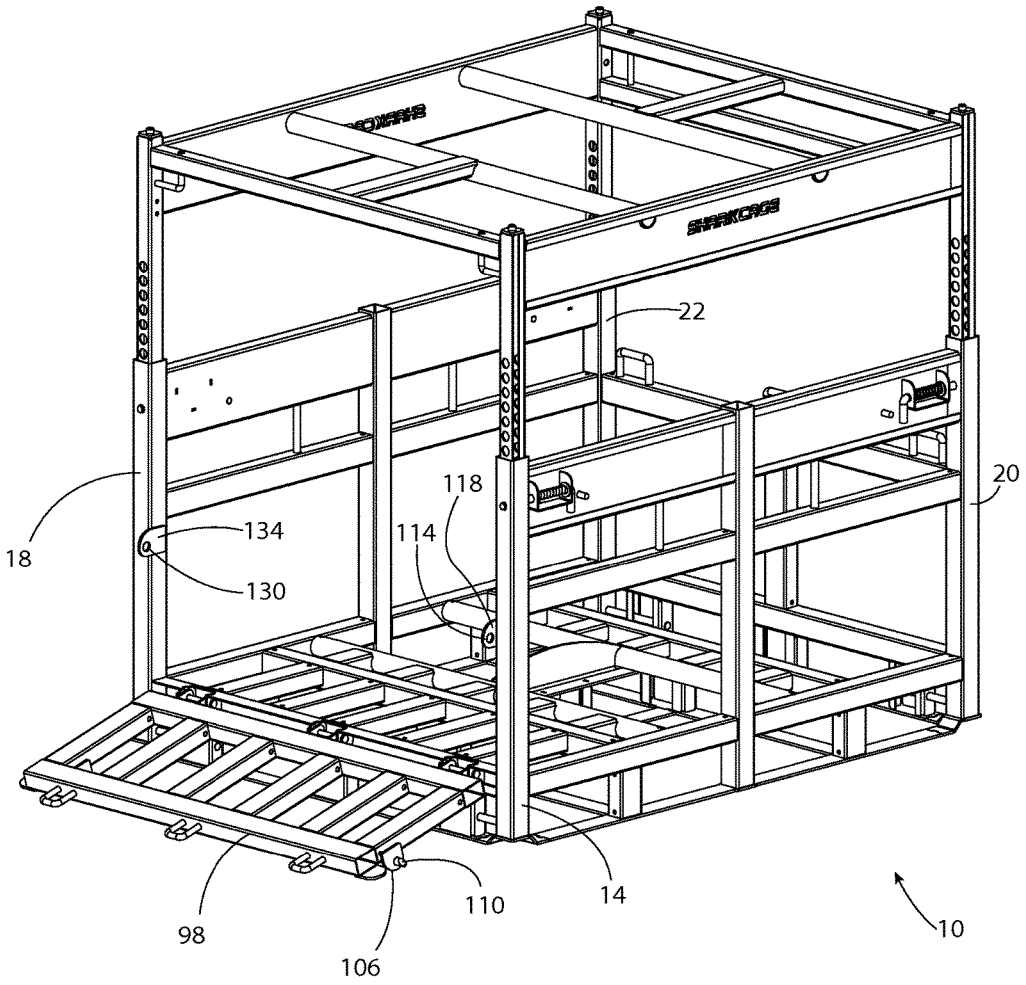
FIG. 7 is a perspective view of the storage and transport container with the rotatable gate opened into a ramp configuration.

FIG. 7 is a perspective view of the container 10 with the front gate 98 rotated into an opened position. In this configuration, the front gate 98 can act as ramp to roll items into the container 10.

Figure 8:
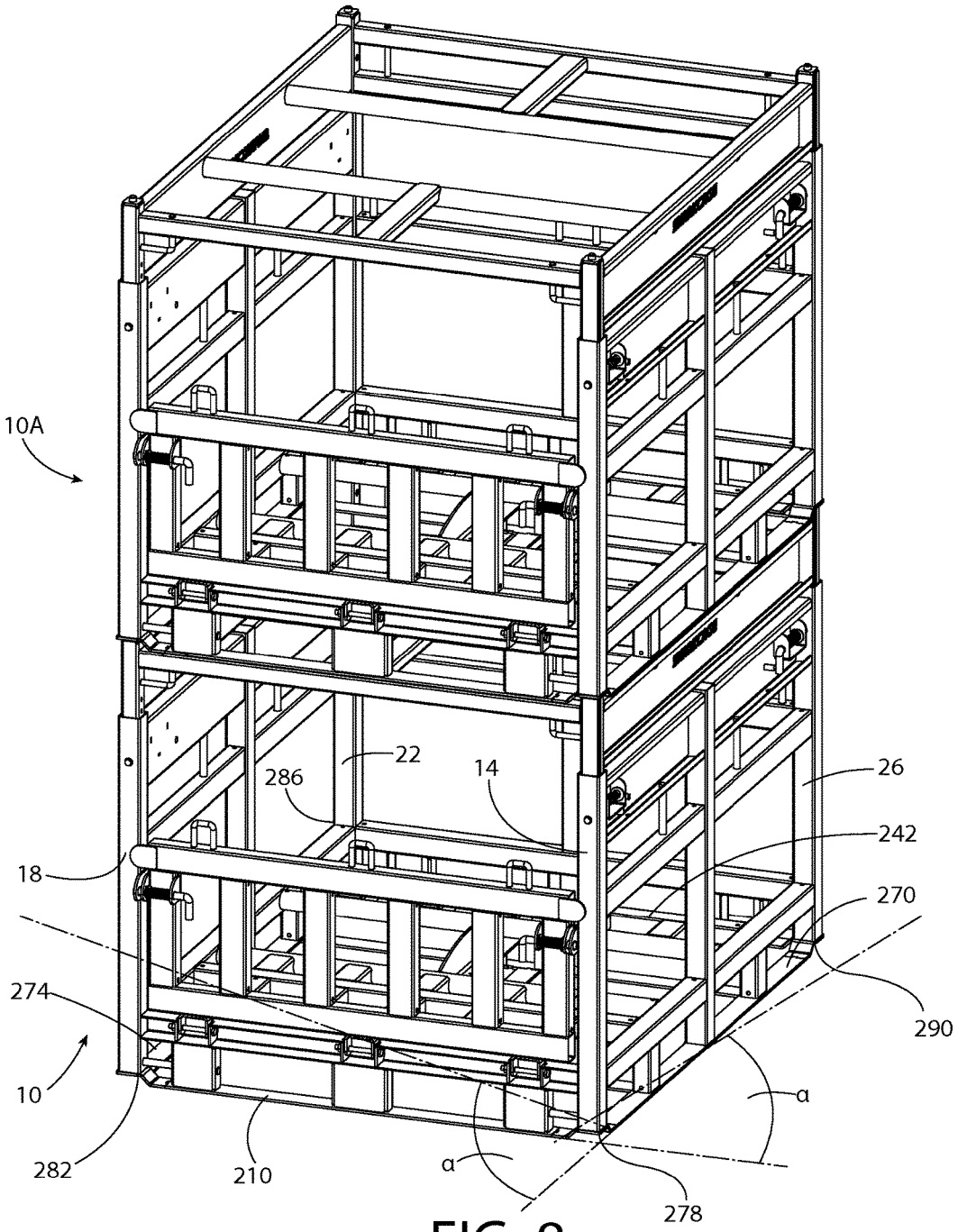
FIG. 8 is a perspective view of the storage and transport container stacked on another storage and transport container.

FIG. 8 shows a first container 10 with a second container 10-A stacked on top of it. The containers have self-centering corners. A first side floor member 270 is attached to first post and fourth post. A second side floor member 274 is attached to the second post 18 and third post 22. The floor front member 210 is generally horizontal until it is near and attaches to the first post 14. Near the first post 14 the horizontal front member 210 makes an angle has an angle $\alpha$ to the horizontal. The bottom of the first post 14 is generally horizontal. Similarly the first side floor member 270 also attaches to the bottom of the first post 14. Near the first post 14 the generally horizontal first side floor member 270 makes an angle $\alpha$ to the horizontal at it attaches to the first post 14. This angling of the first side floor member 270 and the floor front member 210 with the bottom of the first post 14, creates a self-centering configuration at the first corner 278 such that when this first corner 278 is going to be stacked on another container, the first post member 30 of the bottom container will become centered with respect to the first corner 278 due to the guiding influences of the angles $\alpha$ of the floor front member 210 and the first side floor member 270. The second corner 282 is configured to be self-centering similar to the first corner 278, in that the floor front member 210 and second side floor member 274 also makes an angle $\alpha$ when attached to the second post 18. Similarly, the third corner 286 is self-centering, in that the second side floor member 274 and floor rear member 242 also make an angle $\alpha$ when attached to the third post 22. Lastly, the fourth corner 290 is also self-centering, in that the floor rear member 242 and first side floor member 270 also make an angle $\alpha$ when attached to the fourth post 26.

Figure 9:
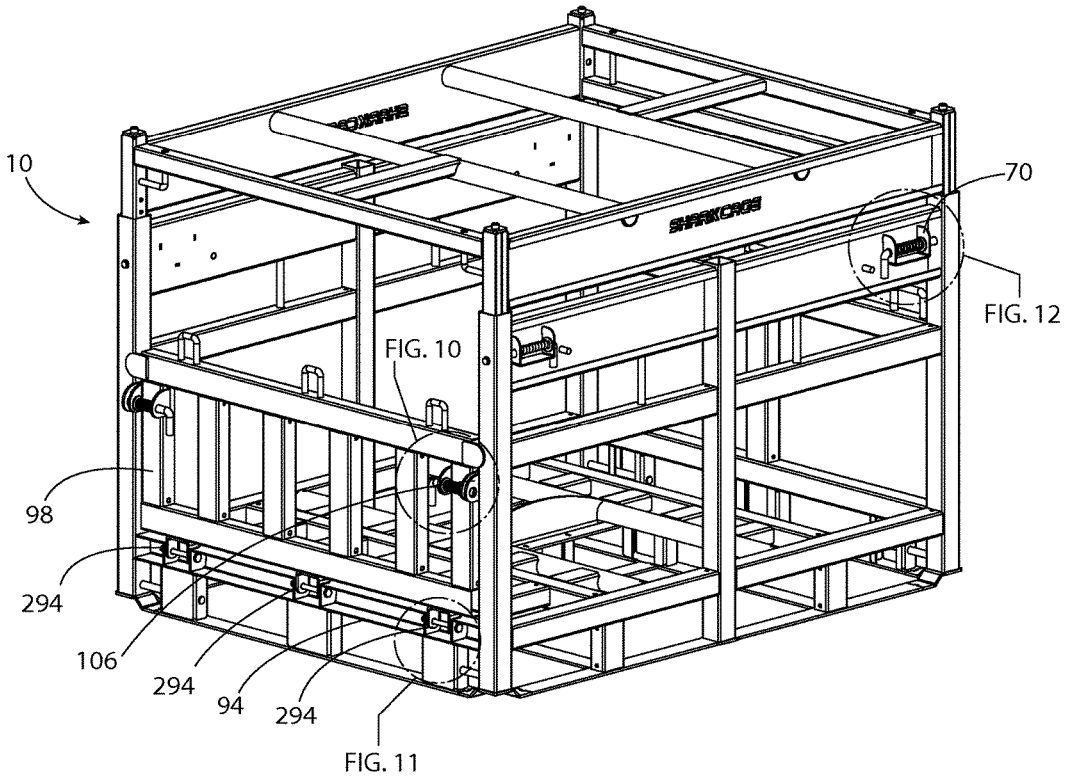
FIG. 9 is a perspective view of the storage and transport container.
Figure 10:
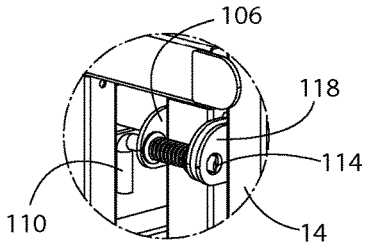
FIG. 10 is a detail view of the first spring loaded gate lock.
Figure 11:
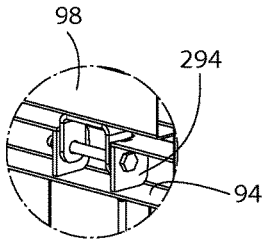
FIG. 11 is a detail view of the gate hinge.
Figure 12:
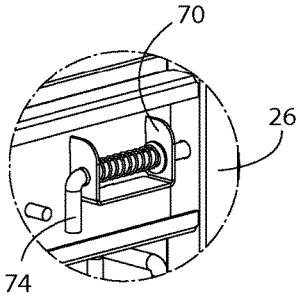
FIG. 12 is a detail view of the fourth spring loaded lock.

FIG. 9 is a perspective view of the container 10. In this figure, the three gate hinges 294 are shown. The gate hinges 294 are attached to the front rotatable gate 98 and the lower front member 94. FIG. 10 is a detail view of the first spring loaded gate lock 106 from FIG. 9. FIG. 11 is a detail view of the hinge 294 from FIG. 9. FIG. 12 is a detail view of the fourth spring loaded lock 70 from FIG. 9.

This invention has many advantages. The top portion of the container can be raised and lowered to fit different wheel sizes for transportation and/or storage of different wheel sizes. The portion of the container may lock the wheels in place during transportation, and may be locked in place by four spring loaded locks. The portion of the container can be raised and lowered, and locked in place, to different heights with respect to the lower portion of the container. Wheels or other items being stored and transported may be locked into place by lowering the top portion of the container on to the top of the wheels or other items. The top portion of the container may be locked in place by four spring loaded locks. The spring loaded locks may be located in each corner of the bottom portion of the container. The two top bars may secure the wheel(s) inside the container during transportation. The wheel may be centered on the two lower bars. The container may have a hinged front gate with spring loaded locks, one at each top corner of the gate. The locking bars have a chamfer, so that when the front gate is closed the spring loaded locks automatically engage. The front gate can be slammed close and it will be locked automatically. The container has self-centering stacking corners, that make it relatively to stack and center the containers on top of one another.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A storage and transport container comprising:

a first post;

a second post;

a third post;

a fourth post;

a first lower side member attached to the first post and the fourth post;

a second lower side member attached to the second post and the third post;

a first lower bar attached to the first lower side member and the second lower side member;

a second lower bar attached to the first lower side member and the second lower side member, the second lower bar parallel to the first lower bar, and at least about 15.5 inches from the first lower bar, center to center;

a first post member slideably attached to the first post, and configured to extend out of and retract into the first post, the first post member comprising a plurality of first member holes located along the length of the first post member;

a second post member slideably attached to the second post, and configured to extend out of and retract into the second post, the second post member comprising a plurality of second member holes located along the length of the second post member;

a third post member slideably attached to the third post, and configured to extend out of and retract into the third post, the third post member comprising a plurality of third member holes located along the length of the third post member;

a fourth post member slideably attached to the fourth post, and configured to extend out of and retract into the fourth post, the fourth post member comprising a plurality of fourth member holes located along the length of the fourth post member;

a first top side member attached to the first post member and the fourth post member;

a second top side member attached to the second post member and the third post member;

a first top bar attached to the first top side member and the second top side member, and parallel to the first and second lower bars;

a second top bar attached to the first top side member and the second top side member, the second top bar parallel to the first top bar, and at least about 20.5 inches from the first top bar, center to center, and parallel to the first and second lower bars;

a first spring loaded lock in communication with the first post, the first spring loaded lock comprising:

a first post hole, the first pole hole configured to be aligned with at least one of the first member holes;

a first locking member configured to slide though the first post hole and at least one first member hole aligned with the first post hole;

wherein depending on which of the first member holes the first locking member has slid through, the first post member is extendable or retractable into the first post;

a second spring loaded lock in communication with the second post, the second spring loaded lock comprising:

a second post hole, the second pole hole configured to be aligned with at least one of the second member holes;

a second locking member configured to slide though the second post hole and at least one second member hole aligned with the second post hole;

wherein depending on which of the second member holes the second locking member has slid through, the second post member is extendable or retractable into the second post;

a third spring loaded lock in communication with the third post, the third spring loaded lock comprising:

a third post hole, the third pole hole configured to be aligned with at least one of the third member holes;

a third locking member configured to slide though the third post hole and at least one third member hole aligned with the third post hole;

wherein depending on which of the third member holes the third locking member has slid through, the third post member is extendable or retractable into the third post;

a fourth spring loaded lock in communication with the fourth post, the fourth spring loaded lock comprising:

a fourth post hole, the fourth pole hole configured to be aligned with at least one of the fourth member holes;

a fourth locking member configured to slide though the fourth post hole and at least one fourth member hole aligned with the fourth post hole;

wherein depending on which of the fourth member holes the fourth locking member has slid through, the fourth post member is extendable or retractable into the fourth post;

wherein the storage and transport container is configured such that the first, second, third and fourth post members is extendable and retractable with respect to the first, second and third, and fourth posts respectively, such that that first and second top bars and the first and second lower bars can abut an object being stored or transported in the container.

2. The storage and transport container of claim 1, wherein the object is a tire.

3. The storage and transport container of claim 1, further comprising:

a plate attached at the midpoint of the first lower bar and at the midpoint of the second lower bar.

4. The storage and transport container of claim 3, wherein the plate has a semi-circular shape.

5. The storage and transport container of claim 1, wherein the first and second top bars and the first and second lower bars are each hollow tubes.

* * * * *